United States Patent [19]

Gotovtseva et al.

[11] 4,313,235

[45] Feb. 2, 1982

[54] METHOD OF TREATING COTTON CLOTH OF TWISTED YARN IN LOOM STATE

[76] Inventors: Ljubov A. Gotovtseva, ulitsa 9 Yanvarya, 30, kv. 28; Maia B. Konkova, prospekt Lenina, 73, kv. 29; Tatyana F. Garbuz, ulitsa 9 Zemledelcheskaya, 3, kv. 55; Oleg A. Bunin, ulitsa Tashkentskaya, 85, "D", kv. 11; Evgeny A. Osminin, ulitsa Gromoboya, 29, kv. 57; Nina A. Zabavina, ulitsa Volodarskogo, 43, kv. 274, all of Ivanovo; Alexei I. Ivanov, ulitsa 1 Maya, 12; Vladimir P. Snopov, ulitsa 1 Polevaya, 30, kv. 19, both of poselok Kamenka Vishugskogo raiona Ivanovskoi oblasti; Alexandr I. Batkov, ulitsa Baturina, 10, kv. 43, Ivanovo, all of U.S.S.R.

[21] Appl. No.: 153,671

[22] Filed: May 27, 1980

[51] Int. Cl.[3] ..... D06B 3/10; D06B 21/00

[52] U.S. Cl. ..... 8/149.1; 8/149.2; 8/149.3; 68/5 D

[58] Field of Search ..... 8/125, 149.1, 149.2, 8/149.3; 68/5 D, 5 E

[56] References Cited

U.S. PATENT DOCUMENTS

| | | | |
|---|---|---|---|
| 1,741,338 | 12/1929 | Rowley et al. | 8/149.1 |
| 2,441,991 | 5/1948 | Converse et al. | 68/5 E |
| 3,664,158 | 5/1972 | Skaathun et al. | 68/5 D |
| 3,685,323 | 8/1972 | Bosch et al. | 68/5 D |

FOREIGN PATENT DOCUMENTS

| | | | |
|---|---|---|---|
| 2037338 | 7/1980 | United Kingdom | 68/5 D |

*Primary Examiner*—Philip R. Coe

[57] ABSTRACT

The invention relates to a method and unit for treating cotton cloth of twisted yarn in loom state. According to the disclosed method, the cloth is boiled with simultaneous mercerization by being alternatingly guided through a boiling solution of caustic soda and the vapor thereof. Following the boiling, the cloth is steamed in a roll under a tension of 5 to 10 kgf/m, whereas the steaming of the cloth, following its bleaching and dyeing, is effected for 1 to 2 minutes under tension, and for 2 to 10 minutes without tension. In the course of the boiling of the cloth with simultaneous mercerization in the vapor phase of caustic soda, and also prior to the steaming in the roll and to the leaching, and during the leaching, the cloth is subjected to stentering.

The unit intended for performing the disclosed method comprises an apparatus for boiling with simultaneous mercerization, including a sealed chamber with a bath for a caustic soda solution and a zone for concentrating caustic soda vapors, situated above the bath and accommodating means for stentering the cloth. Similar cloth-stentering means are also accommodated in the leaching chambers and in front of these chambers, and also in front of the chamber for steaming the cloth after its boiling. The method improves the quality of finished cloth, enables to render the unit more compact and more productive.

3 Claims, 6 Drawing Figures

METHOD OF TREATING COTTON CLOTH OF TWISTED YARN IN LOOM STATE

The present invention relates to the textile industry, and more particularly it relates to methods of treating cotton cloth of twisted yarn in loom state and to units capable of performing such methods.

There are widely known methods of treating cotton cloth in loom state, particularly, a cloth woven of twisted yarn, and apparatus for performing such methods. Thus, in accordance with the method disclosed in the SU Inventor's Certificate No. 407,983; Int. Cl.$^2$ D 06 M 1/08, the cloth is impregnated with a hot (70°–108° C.) water solution of a strong alkali containing 18 to 27% caustic soda and 0.5 to 1.0% surface-active agent; squeezed to the moisture content of 115–120% of the mass of the cloth; heated for 3 to 5 seconds to 106°–108° C.; steamed in a saturated steam atmosphere at 100°–102° C. under a gauge pressure of 2–8 mm water; leached; washed with intermediate neutralization, and bleached.

However, in the course of the impregnation of the cloth woven of twisted yarn with the solution of the strong alkali and its subsequent steaming there is not attained the required degree of purification of the cloth from non-cellulose matter, particularly, from scutch, and the required degree of mercerization (the lustre is inadequate, and the reticular structure of the molecules is not established in full, i.e. the barium number is low), whereby the cloth in its dyed state has a relatively poor appearance, with the pronounced faults of the untreated cloth, e.g. stripiness; neither there are attained the adequate brightness, intensity and fastness of its dyed color.

All these shortcomings can be traced back to the poor degree of the impregnation of the cloth with the hot concentrated alkali, caused by the impregnation bath of the commonly known structure not being fully suitable for the purpose and not providing for utilizing the entire volume of the alkali with a high efficiency to the desired end, because of the aerosol developed by the hot concentrated solution being wasted into the ambient atmosphere or into an air duct. Furthermore, the abovedescribed known method of treating a cloth in loom state with a strong alkali lacks the swelling operation of the traditional (cold) mercerization, when after the impregnation in the chain-type mercerization machines the taut web of the cloth is guided through a system of cold metal cylinders, to have its linear dimensions stabilized and to provide for a more complete reticular structure of the molecules. The cloth treated in this way is more uniformly dyed, better maintains its shape and becomes lustrous.

When the abovedescribed method of treating with hot caustic alkalies is practiced, there takes place the increased shrinkage of the cloth width-wise, owing to the lack of sufficiently effective broadening or spreading, which would not enable to produce fabrics of the standard width and thus impedes wide implementation of this method in the existing plant.

Cloths treated by the abovedescribed hitherto known method are predominantly dyed by the known per se traditional method.

However, the known techniques of dyeing in the equipment operable separately from the cloth preparation units in most cases would not ensure a high quality of the dyeing of cloths and fabrics woven of twisted yarn, apart from these dyeing techniques being laborconsuming and costly. They require additional production floor space, labour and energy, while the repeated wet treatment inflicts additional faults in the cloth, caused by the mechanical action (stripes, wrinkles, tears, etc.), and increased rags.

Recently, there have become ever broadly used the continuous padding and steaming methods of simultaneous bleaching and dyeing with active dyes (cf. the SU Inventor's Certificate No. 255,184, Int. Cl.$^2$ D 06 P) and with solubilized vat dyes (cf. the SU Inventor's Certificate No. 472,179, Int. Cl.$^2$ D 06 P). In practice, these methods are used with direct dyes, too.

However, the methods of simultaneous bleaching and dyeing require the thorough preparation of the cloth during the mercerization and boiling stages. If the abovedescribed known method of pretreating a cloth in loom state, woven of twisted yarn, is mechanically combined with the methods of simultaneous bleaching and dyeing, disclosed in the abovecited Inventor's Certificates, it would be practically impossible to ensure the high quality ratings of the cloth as for retaining of the cellulose polymerization degree (the viscosity rating) and as for the appearance of the cloth (poor brightness and fastness of the dyeing, mechanical faults, etc.). Therefore, there is needed a basically new approach to the selection of the conditions of conducting the cloth pretreating process for simultaneous bleaching and dyeing, same as there is needed the creation of the plant enabling to combine within a single treatment cycle four operations, i.e. mercerization, boiling, bleaching and dyeing, and to attain a high level of all the quality ratings, such as the purification from non-cellulose matter, the degree of mercerization, the uniformity and fastness of the dyeing and the general appearance of the treated cloth, which are used for the evaluation of a finished mercerized, bleached and dyed cloth.

It is an object of the present invention to enhance the effect attained by mercerization, i.e. the lustre and the uniformity, to improve the general appearance of the treated cloth and the brightness of its color attained by the dyeing.

It is another object of the present invention to step up the productivity of the equipment and to render it more compact.

These and other objects are attained in a method of treating cotton cloth in loom state, woven of twisted yarn, including boiling the cloth with simultaneous mercerization in a boiling solution of caustic soda, steaming the cloth and leaching it, and then simultaneously bleaching and dyeing the cloth, with subsequent steaming, washing and drying, in which method, in accordance with the present invention, the boiling of the cloth with its simultaneous mercerization is effected by alternatingly guiding the cloth through the solution of caustic soda and through its vapor, with the treatment time ratio of 1:1, the steaming of the cloth prior to its leaching being effected in a roll into which the cloth is wound under a 5 to 10 kgf/m tension, while the steaming of the cloth after its bleaching and dyeing is effected for 1 to 2 minutes under tension and for 2 to 10 minutes without tension, the cloth being subjected to stentering in the course of the boiling with simultaneous mercerization in the vapor phase of caustic soda, and also prior to the steaming in the roll, prior to the leaching and in the course of the leaching.

The boiling of the cloth with its mercerization, effected by guiding the cloth alternatingly through the solution of caustic soda and through the vapor phase thereof, with the treatment time ratio of 1:1 enable to step up the degree of the impregnation of the cloth with the hot high-concentration solution of caustic soda, and to utilize the entire volume of the alkali for the desired purpose, i.e. for the process of boiling and mercerizing, which improves the appearance of the finished cloth (eliminates structural stripiness).

The steaming of the cloth in the roll into which it is wound under a 5 to 10 kgf/m tension stabilizes the linear dimensions of the cloth, more fully provides for the formation of the recticular structure of cellulose molecules, whereby the cloth is more uniformly dyed, better retains its shape and becomes lustrous.

It is expedient that the boiling of the cloth with its mercerization in the caustic soda solution and the vapor thereof should be conducted for 15 to 25 seconds, to provide for the required degree of the swelling of the cloth in the course of the subsequent steaming.

The invention is further characterized in that the cloth is pre-dried prior to its simultaneous bleaching and dying, which improves the conditions of dyeing the cloth.

In the unit for performing the proposed method, comprising the following components arranged in a succession for treating the cloth: an apparatus for boiling the cloth with its simultaneous mercerization, a chamber for steaming the cloth, chambers for leaching the cloth, washing baths, a bath for the bleaching and dyeing solutions, a chamber for steaming the cloth after its dyeing, washing baths and a drying apparatus, in accordance with the present invention, the apparatus for boiling the cloth with its simultaneous mercerization comprises a sealed chamber with hydraulic seals at the inlet and outlet for the cloth, accommodating in the lower part thereof a bath for a solution of caustic soda, including heaters and a series of guide rollers, the upper part of the chamber, overlying the bath, being the zone for concentrating caustic soda vapors, accommodating the second series of guide rollers and a cloth-stentering device the chamber for steaming the cloth after its boiling and mercerization being a known per se chamber equipped with a device for winding the cloth into a roll; the chamber for steaming the cloth after its bleaching and dyeing being formed of two communicating parts of which the first one in the direction of the advance of the cloth accommodates rollers for guiding the cloth under tension and the second one accommodates a thermostated elbow-shaped shaft of a known per se structure for guiding the cloth without tension, there being provided cloth-stentering devices in the leaching chambers and in front of them, and also in front of the chamber for steaming the cloth after its boiling and mercerization.

The cloth-stentering devices mounted in the apparatus for boiling the cloth with simultaneous mercerization, and also in the leaching chambers and in front of them, and in front of the steaming chamber enable to produce the cloth of the standard widths.

The steaming of the cloth after its bleaching and dyeing, effected for 1 to 2 minutes under tension and for 2 to 10 minutes without tension enables, while having the steaming unit of the compact structure, to provide for complete purification of the cloth from non-cellulose matter, as well as for fine brightness and fastness of the dyed color.

The combination of the four production operations within a single treatment cycle, i.e. of mercerization, boiling, bleaching and dyeing, enables to produce the cloth of a high quality, while substantially reducing the number of the flaws, enhancing the strength of the cloth, its lustre, and its end-use-properties (shrink resistance, wearability).

It is expedient that the upper part of the sealed chamber should include a branch pipe for feeding steam into the caustic soda vapor concentrating zone.

In accordance with one feature of the present invention, each stentering device includes two sets of rollers arranged symmetrically relative to the longitudinal axis of the chamber and spaced in accordance with the width of the cloth, each set including three to five spaced rollers arranged at an angle to the longitudinal axis of the chamber. It is further expedient to have a known per se pre-drying device arranged in front of the bath for the bleaching and dyeing solutions.

Thus, the herein disclosed unit capable of performing the proposed method of treating a cotton cloth of twisted yarn in loom state has a compact structure owing to the elimination of such equipment as a drying apparatus, a threading-in device, etc. The throughput of the unit has been enhanced, owing to the intensification of the boiling process (i.e. hot mercerization with efficient impregnation, and subsequent steaming of the cloth impregnated with the high-concentration alkali solution), which enables to step up the cloth treatment rate in the unit.

Given hereinbelow is a detailed description of an example of conducting the method of treating a cotton cloth of twisted yarn in loom state, and of an apparatus capable of performing this method, according to the invention, with reference being made to the accompanying drawings, wherein.

The disclosed method of treating a cotton cloth of twisted yarn in loom state is conducted, as follows. The continuously moving cloth woven of twisted yarn, e.g. treated serge or reps is impregnated for 15 to 25 seconds with a boiling acqueous solution of caustic soda (sodium hydrate), of 18.0–27.0% by weight concentration, containing (percent by weight): 0.5–0.7 sodium bisulphite; 0.5–1.0 surface-active agent resistant to the action of strong alkali. The impregnation is effected by guiding the cloth alternatingly through the caustic soda solution and the vapor thereof, with the ratio of the treatment time in the solution and in the vapor of about 1:1, with simultaneously stentering the cloth. The cloth impregnated with the abovespecified solution is steamed in a saturated steam atmosphere at 100°–102° C. for at least 30 minutes, while being wound into a roll under a 5 to 10 kgf/m tension. Then the cloth is subjected to leaching, washing with intermediate neutralization with a sulphuric acid solution, of the concentration of 0.5 to 1.0% by weight, and drying to the moisture content of 25 to 30%. To retain the width of the cloth within the required range, the cloth is subjected to stentering prior to the steaming, prior to the leaching and in the course of the leaching. The cloth is dyed with any of various classes of dyes in the same bath where it is bleached in the known per se manner, whereafter the cloth is steamed in a saturated steam atmosphere at 100°–102° C. for 1 to 2 minutes under tension and for 2 to 10 minutes without tension. Then the cloth is washed and dried.

Figure 1:
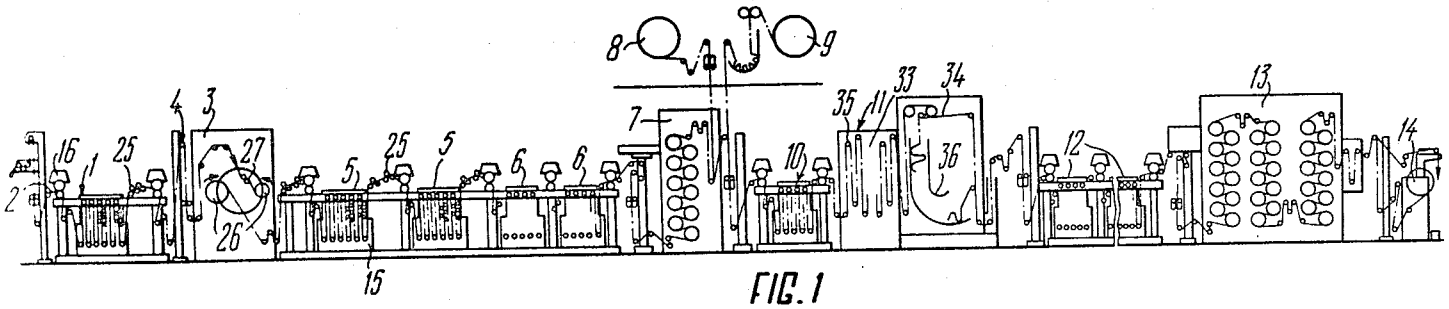
FIG. 1 shows schematically a partly broken away general view of a unit for treating a cotton cloth in loom state.

The unit for performing the proposed method includes such known per se components arranged successively for treating the cloth as an apparatus 1 (FIG. 1) for boiling the cloth 2 with its simultaneous mercerization, a chamber 3 for steaming the cloth 2, incorporating a roller-type compensator 4, two chambers 5 for leaching the cloth; several (e.g. two to four) washing baths 6, a predrying device 7 associated with a winder 8 and an unwinder 9; a bath 10 for the bleaching and dyeing solutions; a chamber 11 for steaming the cloth after its dyeing; several (four or five) washing baths 12, a drying device 13 and a winder 14.

Each leaching chamber 5 includes an impregnating bath 15 accommodated in the lower part of the chamber, and branch pipes for feeding live steam into the upper zone of the chamber 5 (the branch pipes are not shown in the drawing).

The unit further includes known per se squeezing devices 16 arranged between the baths and the chambers, in the areas of guiding the cloth from one treatment zone into the successive one.

Figure 2:
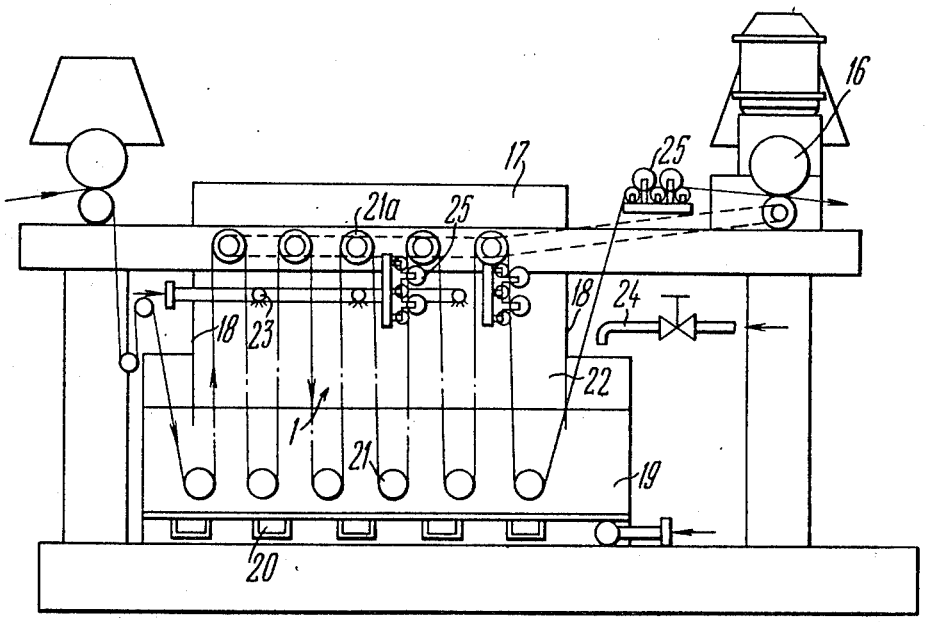
FIG. 2 is the general view of the apparatus for boiling with simultaneous mercerization.

In accordance with the invention, the apparatus 1 for boiling the cloth with its simultaneous mercerization includes a sealed chamber 17 (FIG. 2) with hydraulic seals 18 of a known per se structure at the inlet and outlet for the cloth. The lower part of the sealed chamber 17 accommodates a bath 19 for the caustic soda solution, equipped with steam heaters 20, e.g. of the coil type, and a series of guide rollers 21. The upper part of the chamber 17, overlying the bath 19, is the zone 22 for concentrating caustic soda vapors, accommodating another series of guide rollers **21*a* similar to the rollers 21, a branch pipe 23 for feeding live steam, and tubes 24 for feeding caustic soda into the bath 19. Cloth-stentering devices 25 are arranged under the second series of the guide rollers 21*a*, and in front of the squeezing device 16**.

The chamber 3 (FIG. 1) for steaming the cloth 2 after its boiling and mercerization is a known per se chamber provided with a device for winding the cloth into a roll, including two rollers 26 and threading-in rollers 27.

Figure 3:
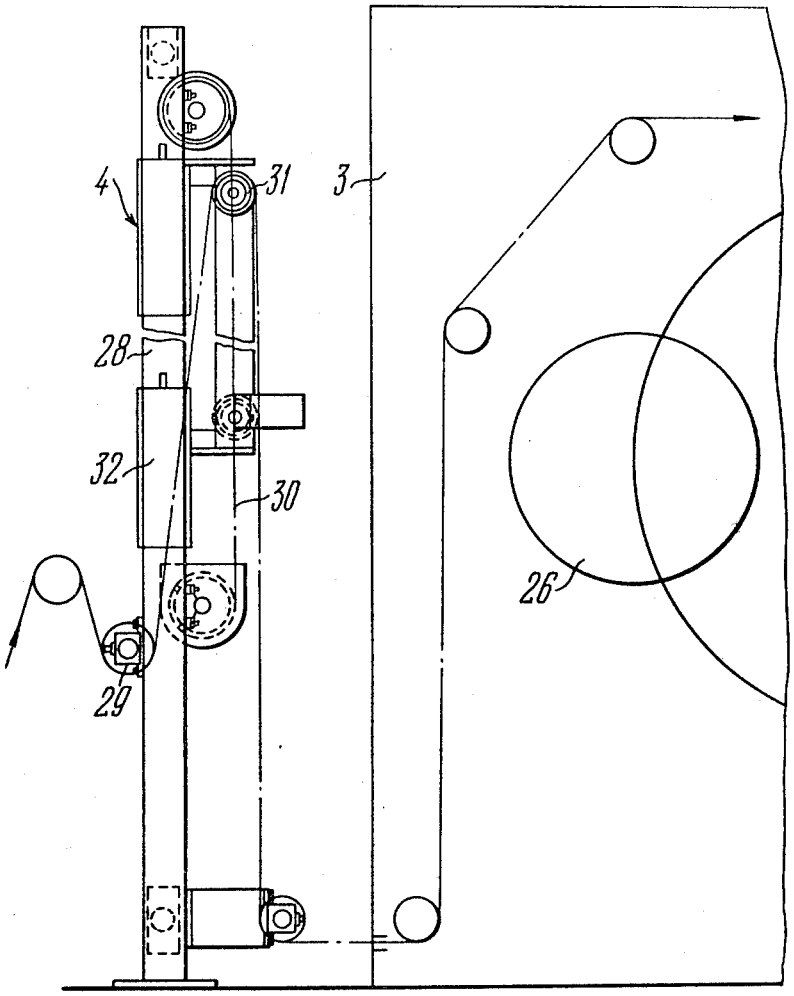
FIG. 3 is the general view of the roller-type compensator.

The roller-type compensator 4 (FIG. 3) at the inlet of the steaming chamber 3 ensures the tension of the cloth being steamed. The roller-type compensator 4 includes a rack 28, guide rollers 29 mounted on the rack 28 and chains 30 supporting a floating roller 31. The roller-type compensator 4 is provided with either a weight (not shown), or a pneumatic cylinder 32 for tensioning the cloth with a predetermined effort.

The chamber 11 (FIG. 1) for steaming the cloth after its bleaching and dyeing is made up of two communicating parts 33 and 34. The part 33 which is the first one in the direction of the progress of the cloth through the unit accommodates rollers 35 of a known per se structure for guiding the cloth under tension, while the second part 34 accommodates a known per se thermostated elbow-shaped shaft 36 for guiding the cloth without tension.

Stentering devices similar to the devices 25 are accommodated within the leaching chambers 5 and in front of them, and also in front of the chamber 3 for steaming the cloth after its boiling with mercerization.

Figure 5:
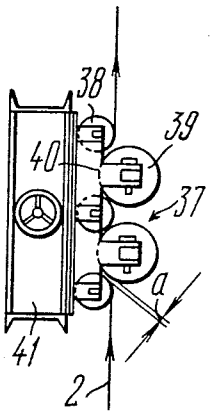
FIG. 5 is a side view of the device of FIG. 4.
Figure 6:
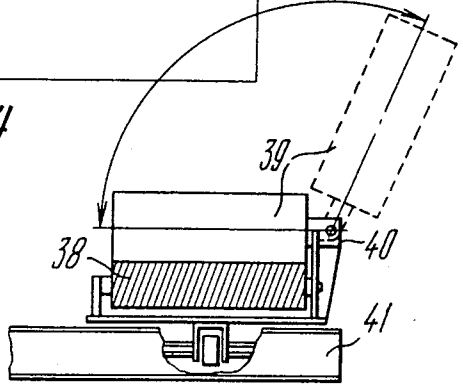
FIG. 6 is a view taken along arrow "A" in FIG. 4.

Each device 25 (FIG. 4) for stentering the cloth comprises two sets 37 of rollers arranged symmetrically with respect to the longitudinal axis of the chamber and spaced in accordance with the width of the cloth. Each set 37 may have three to five rollers. In the embodiment shown, each set 37 includes five rollers, as shown in FIG. 5, arranged one under another and spaced by a distance "a" in excess of the thickness of the cloth. Each set 37 includes rollers 38 with a helically threaded periphery, and rollers 39 with plain peripheries. The brackets 40 support the rollers 38 and 39 on a common frame 41, the rollers 38 (FIG. 6) being stationary, and the rollers 39 being pivotable aside, as illustrated in FIG. 6, to facilitate their cleaning from deposits.

Figure 4:
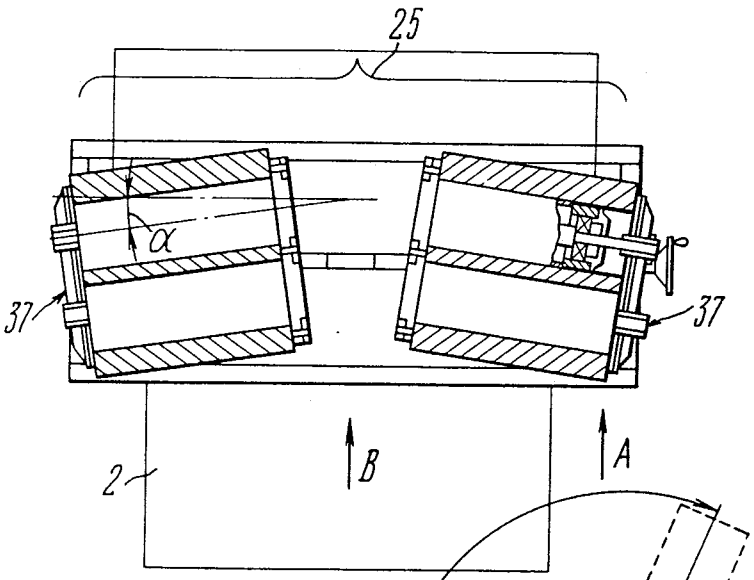
FIG. 4 is the general view of the stentering device.

The rollers 38 and 39 (FIG. 4) in each set 37 are arranged at an angle "$\alpha$" to the longitudinal axis of the chamber, which coincides with the direction of the progress of the cloth, indicated with arrow "B" in FIG. 4.

The unit operates, as follows.

Upon singeing and removal of lint, the cloth 2 (FIG. 1) is fed via a threading-in device into the apparatus 1 for boiling with simultaneous mercerization, where it is impregnated with the concentrated boiling solution of caustic soda, while running alternatingly over the two series of the rollers 21 and **21*a*, i.e. now dipping into the solution and now being subjected to the action of the vapor and aerosol of caustic soda. At the same time, the cloth 2 is subjected to the repeated action of the devices 25** for stentering the cloth, mounted to engage the vertical loops of the cloth above the solution level.

Following the final stentering, the cloth impregnated with caustic soda is fed through the rollers of the squeezing device 16 into the steaming chamber 3 where it is steamed, wound into the roll and maintained within the steam phase for the required time. The cloth is rolled onto each one of the rollers 26 of the chamber 3 in two layers, with the cloth being wound onto one of the rollers (the one nearer to the exit in FIG. 1), and unwound from the other roller. Following the exhaustion of the cloth on the output roller, the rollers 27 guide the cloth onto the inlet one, whereafter the direction of the rotation of the rollers 26 is reversed, and the winding cycle repeats itself. Throughout the steaming period, the cloth is in the spread state, both warp- and weft-wise.

Then the cloth is guided through the leaching chambers 5 where it is subjected to the combined action of the hot liquid, steam and stentering devices 25. Following the leaching, the cloth is neutralized and washed in several washing baths 6, for complete removal of the chemicals. Then the cloth is pre-dried and heated in the pre-drying device 7, whereafter it is impregnated with the bleach and dye solution in the bath 10, and guided into the steaming chamber 11 where the bleaching and fixing of the dye on the cloth take place. Then the cloth is guided through the washing baths 12, the dryer 13 and into the winder 14.

The herein disclosed method is illustrated by the following examples.

EXAMPLE 1

A cloth in loom state of 240 g/m$^2$ mass, woven of twisted yarn, is mercerized and boiled in a boiling aqueous solution containing, percent by weight, 20–22 caustic soda and 0.8–1.0 surface-active agent resistant to the action of strong alkalies, the mercerization and boiling process being conducted by guiding the cloth alternatingly through the caustic soda solution and its vapor, with the treatment time ratio of 1:1 at 100°–106° C, for 25 seconds, with simultaneous stentering. Following this, the cloth is heated for 5 seconds to 106° C. and steamed in a saturated steam atmosphere at 100°–102° C, the steaming process being conducted with the cloth tensioned at 5 kgf/m, wound into a roll for 45 minutes, with subsequent leaching, neutralization and washing; while the bleaching and dyeing process are conducted simultaneously, with subsequent steaming for two minutes with the cloth tensioned, and for two minutes with the cloth slack.

EXAMPLE 2

A cloth in loom state of 140 g/m$^2$ mass is mercerized and boiled in a boiling solution containing, percent by weight, 25–27 caustic soda and 0.5 to 0.8 surface-active agent resistant to concentrated alkalies. The following treatment is similar to that of Example 1, with the impregnation with the aqueous solution and vapors of caustic soda being conducted for 15 seconds; prior to the steaming the cloth is heated to 108° C. for 3 seconds; the steaming in the roll is conducted at a 10 kgf/m tension for 30 minutes, and the steaming after the simultaneous bleaching and dyeing is conducted for 2 minutes under tension and for 10 minutes without tension.

EXAMPLE 3

A cloth in loom state of 190 g/m$^2$ mass is mercerized and boiled in a boiling aqueous solution containing 18–20% by weight caustic soda and 0.5% by weight surface-active agent resistant to concentrated alkalis. The following treatment is similar to that of Example 1, except that the impregnation with the aqueous solution and vapors of caustic soda is carried out for 20 seconds; prior to the steaming, the cloth is heated to 106° C. for 4 seconds; the steaming in the roll is conducted with the cloth tensioned at 8 kgf/m for 40 minutes; and the steaming after the simultaneous bleaching and dyeing is conducted for 1.5 minutes with the cloth tensioned, and for 6 minutes with the cloth slack.

What we claim is:

1. A method of treating a continuously moving cotton cloth of twisted yarn in loom state comprising the steps of; boiling the continuously moving cloth with simultaneous mercerization in a boiling solution of caustic soda, said boiling of the cloth with simultaneous mercerization being conducted with the cloth being guided alternatingly through the solution of caustic soda and vapors thereof, with the treatment time ratio of 1:1; then steaming the cloth on a roll, under a tension of 5 to 10 kgf/m; then leaching the cloth; then simultaneously bleaching and dyeing the cloth; then steaming the cloth, with said steaming being conducted from 1 to 2 minutes under tension and for 2 to 10 minutes without tension; then washing and drying the cloth; and subjecting the cloth to stentering in the course of said boiling with simultaneous mercerization in the caustic soda vapor phase, prior to said steaming on the roll, prior to said leaching, and in the course of said leaching.

2. A method of claim 1, wherein said boiling the cloth with simultaneous mercerization in the solution and vapors of caustic soda is conducted for 15 to 25 seconds.

3. A method of claim 1, including pre-drying the cloth prior to said simultaneous dyeing and bleaching.

* * * * *